US005128313A

United States Patent [19]

Aono

[11] Patent Number: 5,128,313

[45] Date of Patent: Jul. 7, 1992

[54] THERMAL TRANSFER IMAGE RECEIVING MATERIAL

[75] Inventor: Toshiaki Aono, Kanagawa, Japan

[73] Assignee: Fuji Photo Film Co., Ltd., Kanagawa, Japan

[21] Appl. No.: 510,909

[22] Filed: Apr. 18, 1990

[30] Foreign Application Priority Data

Apr. 20, 1989 [JP] Japan ..... 1-98707

[51] Int. Cl.[5] ..... B41M 5/035; B41M 5/26

[52] U.S. Cl. ..... 503/227; 428/195; 428/478.2; 428/913; 428/914

[58] Field of Search ..... 8/471; 428/195, 913, 428/914, 478.2; 503/227

[56] References Cited

U.S. PATENT DOCUMENTS 4,626,256 12/1986 Kawasaki et al. ..... 8/471
4,778,782 10/1988 Ito et al. ..... 503/227
4,943,555 7/1990 Nakamoto et al. ..... 503/227
4,992,414 2/1991 Kishida et al. ..... 503/227

*Primary Examiner*—Bruce H. Hess
*Attorney, Agent, or Firm*—Sughrue, Mion, Zinn, Macpeak & Seas

[57] ABSTRACT

A thermal transfer image receiving material comprising a support having thereon at least one image receiving layer which accepts a dye to form an image, the dye migrating from a thermal transfer dye providing material when heated, wherein the image receiving layer comprises a water-soluble binder containing a dye accepting substance dispersed therein, and at least the outermost layer of the image receiving side-constituting layers of the image receiving material contains at least a dye accepting polymer or a dye accepting polymer blend each having a glass transition point (Tg) of not lower than 20° C. as a dye accepting substance which is dispersed in a water-soluble binder in the at least outermost layer.

6 Claims, No Drawings

THERMAL TRANSFER IMAGE RECEIVING MATERIAL

FIELD OF THE INVENTION

This invention relates to a thermal transfer image receiving material for use in a thermal transfer process using thermomobile dyes. More particularly, this invention relates to a thermal transfer image receiving material which has excellent suitability for production, a high picture quality and an improved image storage stability and scarcely causes problems with regard to the heat fusion thereof to dye providing materials during thermal transfer and the re-transfer of the dye to other materials (color migration by contact) after transfer.

BACKGROUND OF THE INVENTION

Various information processing systems have been developed as a result of the rapid development which has taken place in the information industry in recent years. Methods of recording and apparatus compatible with these information processing systems have been developed and adopted. Thermal transfer recording methods, as one of recording methods of this type, involve the use of, an apparatus which is light and compact, with which there is low noise during operation, and which has excellent operability and maintenance characteristics. Moreover, since they also allow coloring to be achieved easily, these methods are the most widely used. Thermal transfer recording methods can be broadly classified into two types, namely, thermofusion types and thermomobile types. In the latter case, a thermal transfer dye providing material which has, on a support, a dye providing layer which contains a binder and a thermomobile dye is laminated with a thermal transfer image receiving material, heat is applied from the support side of the dye providing material, the thermomobile dye is transferred to the recording medium (thermal transfer image receiving material) in the form of a pattern corresponding to the heat pattern which has been applied and an image is formed in this way.

Moreover, a thermomobile dye is, for example, a dye which can be transferred from a thermal transfer dye providing material to a thermal transfer image receiving material by sublimation or diffusion in a medium.

However, the following disadvantages are encountered with thermal transfer image receiving materials for use in the thermomobile type thermal transfer recording method.

The polymers used in the receiving layer for the thermomobile dye are soluble in organic solvents and so an organic solvent system is used for the receiving layer coating liquid. Furthermore, the apparatus and vessels used in the manufacturing process must be cleaned with organic solvents. Hence, the apparatus used for preparing the coating liquid and the coating apparatus must be explosion-proof. Furthermore, organic solvents are very expensive when compared to water and so the production costs are increased. Moreover, problems can arise with respect to the health of the operators.

Various attempts have been made to obtain a high transfer density and high sensitivity in the thermalmobile type thermal transfer recording method. However, these methods have various problems.

(1) Method wherein dye accepting polymers with a low glass transition point is used This method has problems in that when the dye accepting polymer has a glass transition point which is at room temperature or lower to obtain sufficient density, the transferred image is faded or the transferred dye is re-transferred to the contact surface (i.e., color migration by contact) when image receiving materials after transfer are placed on one another.

(2) Method wherein plasticizers such as oil capable of dissolving dyes are incorporated in image receiving layers, etc.

This method has problems such as fading of the transferred image with the passage of time, and re-transfer as in the above method (1). Further, this method has the problem in that sticking (blocking) is liable to be caused when raw image receiving materials prepared in this method are placed on one another and stored.

(3) Method wherein a porous layer containing porous particles, etc. is provided as a low thermal conductive layer to prevent heat from diffusing during thermal transfer and to raise the temperature of transfer surface This method has a problem in that gloss on the surfaces of the image receiving materials is reduced.

(4) Methods wherein synthetic paper having voids is used as a support

This method has problems in that curling is liable to be caused after thermal transfer and the costs of the materials are high.

(5) Method wherein the amount of dye in the dye providing layers of the dye providing materials is increased This method has problems in that when the dye providing materials are stored over a long period of time, the dyes migrate to the back side of the support or are precipitated out on the surfaces thereof to thereby cause lowering or unevenness in the contents.

(6) Method wherein voltage to be applied to thermal head is elevated

This method has problems in that the life of the thermal head is shortened and the heat fusion of the image receiving material to the dye providing material is likely to occur.

Accordingly, the present invention is intended to solve the above-described problems which are caused when the dye accepting substances are coated as organic solvent solutions.

SUMMARY OF THE INVENTION

An object of the present invention is to provide a thermal transfer image receiving material which is relatively free from such problems as the fading of the transferred image with the passage of time and the retransfer of dye to other materials (color migration by contact) after transfer.

Another object of the present invention is to provide a thermal transfer image receiving material which can obtain a high transfer density and high sensitivity without causing the above-described problems.

The above-described and other objects have been achieved by providing a thermal transfer image receiving material comprising a support having thereon at least one image receiving layer which accepts a dye to form an image, the dye migrating from a thermal transfer dye providing material when heated, wherein the image receiving layer comprises a water-soluble binder containing a dye accepting substance dispersed therein, and at least the outermost layer of the image receiving side-constituting layers of the image receiving material contains at least a dye accepting polymer or a dye accepting polymer blend each having a glass transition point (Tg) of not lower than 20° C. as a dye accepting substance which is dispersed in a water-soluble binder in at least outermost layer.

DETAILED DESCRIPTION OF THE INVENTION

In the present invention, the dye accepting substance is not coated in the form of an organic solvent solution as in conventional methods, but the dye accepting substance is dispersed in a water-soluble binder and the dispersion is coated. Hence, coating can be carried out by using water as a solvent. Thus, there is no risk of explosion, the manufacturing costs can be markedly reduced and adverse effects on operator health are greatly reduced. Further, the present invention has advantages in that the layer containing the dye accepting substance dispersed in the water-soluble binder can sufficiently accept a thermomobile dye to thereby give an image having a high transfer density and the resulting image scarcely causes fading of the image during long-term storage and re-transfer of the dye to other materials (color migration by contact) after transfer.

Now, the present invention will be illustrated in more detail below.

The thermal transfer image receiving material of the present invention is provided with an image receiving layer. The image receiving layer comprises a thermomobile dye accepting substance. dispersed in a water-soluble binder. The thermomobile dye accepting substance accepts a thermomobile dye migrating from a thermal transfer dye providing material and then fixes the thermomobile dye.

Typical examples of thermomobile dye accepting substances include polymers. In the present invention, at least a dye accepting polymer or a dye accepting polymer blend each having a glass transition point (Tg) of not lower than 20° C., preferably not lower than 40° C., particularly preferably not lower than 55° C. is incorporated in the water-soluble binder of at least the outermost layer of the image receiving side-constituting layers of the image-receiving material.

When the outermost layer contains two or more dye accepting polymers, the mixture must have a glass transition point described above.

When the glass transition point of the dye accepting polymer or the dye accepting polymer blend is too high, the dye is poorly diffused during transfer. Accordingly, the glass transition point is generally not higher than 250° C., preferably not higher than 200° C., particularly preferably not higher than 100° C.

Examples of the polymers which can be used in the present invention include, but are not limited to, the following Compounds (1) to (37).

| | Tg |
|---|---|
| (1) Polyethylene adipate | −70° C. |
| (2) Nylon 6,6 | −68° C. |
| (3) Polyvinylidene chloride | −27° C. |
| (4) Ethyl cellulose | −17° C. |
| (5) Cellulose tributyrate | 43° C. |
| (6) Poly-ε-aminocapramide | 50° C. |
| (7) Cellulose acetate | 64° C. |
| (8) Polyhexamethyleneadipamide | 50° C. |
| (9) Cellulose tributyrate | 45° C. |
| (10) Polyvinyl acetate | 33° C. |
| (11) Polymethyl methacrylate | 72° C. |
| (12) Polycarbonate | 140° C. |
| (13) Poly(bisphenol A terephthalate) | 205° C. |

-continued

| | Tg |
|---|---|
| (14) Poly(oxyethyleneoxyadipoyl) | −63° C. |

The following polymers which are commercially available as non-crystalline polyesters can be preferably used.

| | Tg |
|---|---|
| (15) Vylon ® RV290 (Product of Toyobo Co., Ltd.) | 77° C. |
| (16) Vylon ® RV103 (Product of Toyobo Co., Ltd.) | 47° C. |
| (17) Vylon ® GK590 (Product of Toyobo Co., Ltd.) | 15° C. |
| (18) Vylon ® RV600 (Product of Toyobo Co., Ltd.) | 47° C. |
| (19) Vylon ® GK590 (Product of Toyobo Co., Ltd.) | 15° C. |
| (20) Vylon ® GK150 (Product of Toyobo Co., Ltd.) | 26° C. |
| (21) Vylon ® GK130 (Product of Toyobo Co., Ltd.) | 24° C. |
| (22) Vylon ® RV300 (Product of Toyobo Co., Ltd.) | 7° C. |
| (23) Vylon ® RV630 (Product of Toyobo Co., Ltd.) | 7° C. |
| (24) Vylon ® RV560 (Product of Toyobo Co., Ltd.) | 7° C. |
| (25) VYlon ® RV530 (Product of Toyobo Co., Ltd.) | 7° C. |
| (26) Vylon ® RV500 (Product of Toyobo Co., Ltd.) | 4° C. |
| (27) Polymer consisting of IPA(24), TPA(24), SSIA(2), BPA(35), EG(15) | 70° C. |
| (28) Polymer consisting of IPA(24), TPA(26), EG(22), NPG(28) | 67° C. |
| (29) Polymer consisting of IPA (24), TPA(24), SSIA(2), EG(23), NPG(27) | 65° C. |

wherein,

IPA; 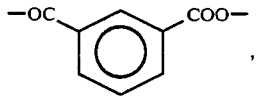

TPA; 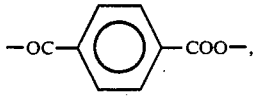

SSIA; 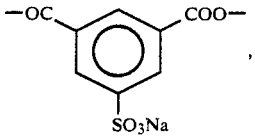

SBA; $-OC(CH_2)_8COO-$,

EG; $-CH_2CH_2O-$,

NPG; $-CH_2\underset{\underset{CH_3}{|}}{\overset{\overset{CH_3}{|}}{C}}-CH_2O-$, BPA; 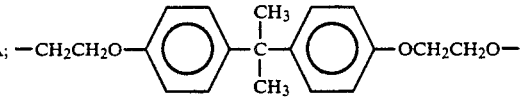

Parenthesized numerals in the polymers (27) to (29) represent the composition ratio (%) of the monomers.

| | Tg |
|---|---|
| (30) Pasresin S ® 130S (Product of Takamatsu Yushi K.K.) | −10° C. |
| (31) Pasresin S ® 110 (Product of Takamatsu Yushi K.K.) | 60° C. |
| (32) Pasresin S ® 110S (Product of Takamatsu Yushi K.K.) | 60° C. |
| (33) Pasresin S ® 110G (Product of Takamatsu Yushi K.K.) | 60° C. |
| (34) Pasresin S ® 230 (Product of Takamatsu Yushi K.K.) | 10° C. |
| (35) Pasresin S ® 230S (Product of Takamatsu Yushi K.K.) | 10° C. |
| (36) Pasresin S ® 230G (Product of Takamatsu Yushi K.K.) | 10° C. |
| (37) Poly(oxy-5-nonyl-1,3-phenyleneoxy- | 31° C. |

-continued

| | Tg |
|---|---|
| isophthaloyl) | |

These dye accepting polymers may be used either alone or as a blend of two or more. When a blend is used, the glass transition point (Tg) of the blend may be directly measured. Alternatively, the glass transition point may be determined by the following formula (1) on the presumption that the dye accepting polymer blend is a uniform system.

$$Tg^{-1}=w_1Tg_1^{-1}+w_2Tg_2^{-1} \quad (1)$$

wherein $Tg_1$ and $Tg_2$ are each Tg of two dye accepting polymers 1 and 2; Tg is the Tg of the blend; and $w_1$ and $w_2$ are each weight fractions of the dye accepting polymers 1 and 2.

It is particularly preferred that the image receiving layer is composed of two or more layers having different compositions. In the present invention, at least the above-described dye accepting polymer or dye accepting polymer blend each having a glass transition point of not lower than 20° C. is incorporated in at least the outermost layer of the layers of the image receiving material. In the preferred embodiments, high-boiling organic solvents or thermal solvents are used in a layer nearer to the support to increase dyeing affinity with the dye. Alternatively, fluorine compounds are incorporated in the outermost layer, and optionally, the irfeducible minimum amounts of the high-boiling organic solvents or the thermal solvents are used in the outermost layer, or the ratio of the dye accepting polymer content to the water-soluble binder is lowered in the outermost layer. In these preferred embodiments, there is no surface stickiness, the image receiving material can be prevented from sticking to other materials, the retransfer of the dye to other materials can be prevented from being caused and the heat fusion (blocking) to the thermal transfer dye providing material can be prevented from being caused. It is particularly preferred that release agents described hereinafter are used in the outermost layer. The term "blocking" means that when the thermal transfer dye providing material and the thermal transfer image receiving material are superimposed upon each other and heat is applied thereto to transfer a thermomobile dye from the dye providing material to the image rece3iving material, the dye providing layer of the dye providing material and the image receiving layer (the outermost layer) of the image receiving material are thermally fused to each other. As a result, there is the possibility that the dye providing layer is peeled off and sticks to the surface of the image receiving layer, or sometimes there may be a problem in that the image receiving material can no longer be conveyed and the printer is stopped.

When the image receiving layer is composed of two or more layers, it is particularly preferred from the viewpoint of achieving high transfer density and high sensitivity that a dye accepting polymer or a dye accepting polymer blend each having a glass transition point lower than that of the dye accepting polymer or the dye accepting polymer blend to be incorporated in the outermost layer is used in the layer nearer to the support, although dye accepting polymer or dye accepting polymer blend each having any glass transition point can be used in the layer nearer to the support. When the dye accepting polymer or the dye accepting polymer blend each having a Tg of not higher than 20° C. forms a uniform layer (in the case of no water-soluble binder), the image is faded during long-term storage. However, when the dye accepting polymer or the dye accepting polymer blend is dispersed in the water-soluble binder having a poor dye-acceptability as in the present invention, the image can be prevented from being faded. Accordingly, it becomes possible to use dye accepting polymers or the dye accepting polymer blend each having a Tg of not higher than 20° C. in a layer nearer to the support.

High-boiling organic solvents or thermal solvents as thermomobile dye accepting substances or dye diffusion aids can be incorporated in the thermal transfer image material, particularly the image receiving layer. In view of the fading of the image during storage, etc., the thermal solvents are preferred to the high-boiling organic solvents.

Examples of the high-boiling organic solvents include esters (e.g., phthalic esters, phosphoric esters, fatty acid esters), amides (e.g., fatty acid amides, sulfonamides), ethers, alcohols, paraffins and silicone oils as described in JP-A-59-83154 (the term "JP-A" as used herein means an "unexamined published Japanese patent application"), JP-A-59-178451, JP-A-59-178452, JP-A-59-178453, JP-A-59-178454, JP-A-59-178455, and JP-A-59-178457.

As the thermal solvents, there can be used compounds having such properties that (1) they are compatible with the dyes; (2) they are solid at room temperature, but are molten (may be molten together with other components) when heated by a thermal head during transfer; and (3) they are not decomposed by heat from the thermal head. Compounds having a melting point of preferably 35° to 250° C., particularly 35° to 200° C. and a value (inorganic character/organic character) $<1.5$ are preferred. The terms "inorganic character" and "organic character" as used herein refer to a concept for forecasting the properties of compounds. They are described in detail in *The Realm of Chemistry*, 11, page 719(1957).

Specific examples of the high-boiling organic solvents and the thermal solvents include compounds described in JP-A 62-174754, JP-A-62-245253, JP-A-61-209444, JP-A-61-200538, JP-A-62-8145, JP-A-62-9348, JP-A-62-30247 and JP-A-62-136646.

The high-boiling organic solvent and/or the thermal solvent can be used singly in the state where the high-boiling organic solvent and/or the thermal solvent are/is microscopically dissolved or dispersed in the image receiving layer. If desired, they may be mixed with the thermomobile dye accepting polymer or the thermomobile dye accepting polymer blend.

The above-described high-boiling organic solvents may be used for the purpose of improving slipperiness, releasability, curl balance, etc.

The image receiving layer of the thermal transfer image receiving material of the present invention has such a structure that the substance capable of accepting the thermomobile dye is dispersed in a water-soluble binder and carried thereon. Conventional water-soluble polymers can be used as the water soluble binder. However, water-soluble polymers having a group capable of being crosslinked in the presence of hardening agents are preferred. Further, polymers which themselves have poor dye-acceptability are preferred from the viewpoints of fading and color migration by contact.

Examples of the water-soluble polymers which can be used in the present invention include vinyl polymers and derivatives such as polyvinyl pyridinium and cation-modified polyvinyl alcohol (see, JP-A-60-145879, JP-A-60-220750, JP-A-61-143177, JP-A-61-235182, JP-A-61-245183, JP-A-61-237681 and JP-A-61-261089); polymers having an acryloyl or methacryloyl group such as polyacrylamide, polydimethylacrylamide, polydimethylaminoacrylate, polyacrylic acid and salts thereof, acrylic acid-methacrylic acid copolymer and salts thereof, polymethacrylic acid and salts thereof and acrylic acid-vinyl alcohol copolymers and salts thereof (see, JP-A-60-168651, JP-A-62-9988); natural polymers and derivatives such as dextrin, sodium alginate, gelatin, gum arabic, casein, pullulan, dextran, methyl cellulose, ethyl cellulose and carboxymethyl cellulose (see, JP-A-59-174382, JP-A-60-262685, JP-A-61-143177, JP-A-61-181679, JP-A-61-193879 and JP-A-61-287782); synthetic polymers such as polyethylene glycol, polypropylene glycol, polyvinyl methyl ether, maleic acid-vinyl- acetate copolymers, maleic acid-N-vinylpyrrolidone copolymers, maleic acid-alkyl vinyl ether copolymers and polyethyleneimine (see, JP-A-61-32787, JP-A-61-237680 and JP-A-61-277483); and water-soluble polymers described in JP-A-56-58869.

Further, various copolymers which are made water-soluble by using monomer components having a $SO_3^-$ group, a $COO^-$ group or a $SO_2^-$ group can also be used.

It is particularly preferred to use gelatin as the water-soluble binder, because set drying can be carried out and the drying load is very low. Examples of gelatin which can be used in the present invention include gelatin and derivatives thereof such as lime-processed gelatin, lime-processed gelatin which has been subjected to a calcium removal treatment, acid-processed gelatin, phthalated gelatin, acetylated gelatin and succinated gelatin; and enzyme-processed gelatin, gelatin hydrolyzate and enzymatic decomposate of gelatin described in *Bull. Soc. Phot. Japan*, No. 16, p. 30(1966).

These water-soluble polymers may be used either alone or in a combination of two or more.

The water-soluble binder and the dye accepting substance are used in a ratio by weight of the dye accepting substance/the water-soluble binder of 1 to 20, preferably 2 to 10, particularly preferably 3 to 7.

In the image receiving layer containing the dye accepting polymer or the dye accepting polymer blend than 20° C. according to the present invention, the amount of the dye accepting polymer or the dye accepting polymer blend each having a Tg of not lower than 20° C. based on that of the dye accepting substances is not less than 30% by weight, preferably 40 to 90% by weight, particularly preferably 50 to 80% by weight.

The dye accepting substances can be dispersed in the water-soluble binders by any of the conventional dispersion methods for dispersing hydrophobic substances in water-soluble polymers. Preferable methods thereof include a method wherein a solution of the dye accepting substance in a water-immiscible organic solvent is emulsified and dispersed in an aqueous solution of the water-soluble binder.

The image receiving layer has an overall thickness of 0.5 to 50 μm, preferably 2 to 20 μm. The outermost layer has a thickness of 0.1 to 3 μm, preferably 0.2 to 1.5 μm when the image receiving layer is composed of two or more layers.

Any of the conventional supports used for the thermal transfer image receiving materials can be used in the present invention without particular limitation. Materials in which the thermomobile dyes are highly diffusible can also be used as supports in the present invention.

Examples of the supports include (1) synthetic paper (e.g., polyolefin or polystyrene based synthetic paper), (2) paper supports such as the best quality paper, art paper, coated paper, cast coated paper, wall paper, lining paper, synthetic resin or emulsion-impregnated paper, synthetic rubber latex-impregnated paper, paper containing synthetic resins internally added, cardboard, cellulose fiber paper and polyolefin coated paper (particularly paper both surfaces of which are coated with polyethylene), and (3) various plastic films or sheets such as films or sheets of polyolefins, polyvinyl chloride, polyethylene terephthalate, polystyrene, methacrylates and polycarbonates, or films or sheets obtained by treating these plastic films or sheets to impart white color reflecting properties.

Further, laminates composed of any combinations of the above (1) to (3) can be used.

Among them, polyolefin-coated paper is preferred, because recessed deformation is not caused by heating during thermal transfer, they are excellent in whiteness and curling is limited.

Polyolefin coated paper is described in, for example, *The Fundamental of Photo-engineering (Silver Salt Photography Edition)*, edited by Japanese Photography Society, pages 223–240(1979), published by Corona Sha. The polyolefin-coated paper comprises basically a support sheet and a polyolefin layer coated thereon. The support sheet is composed of a material other than synthetic resins, and the best quality paper is generally used. A polyolefin coat may be provided on the surface of the support sheet by any method, so long as the polyolefin layer sticks fast to the surface of the support sheet. Generally, an extrusion coating method is used. The polyolefin layer may be provided only on the surface of the image receiving layer side of the support sheet. If desired, the polyolefin layer may be provided on both sides of the support sheet. Any of the high-density polyethylenes, low-density polyethylenes and polypropylenes can be used as the polyolefin. However, it is preferred that low-density polyethylenes having a low thermal conductivity are used for the side on which the image receiving layer is provided when the heat insulation effect during transfer is taken into consideration.

Though there is no particular limitation with regard to the thickness of the polyolefin coat, a thickness of 5 to 100 μm per one side is generally preferred. However, a thinner polyolefin coating on the image receiving layer side is preferred to obtain a higher transfer density. Pigments such as titanium oxide and ultramarine and fillers may be added to the polyolefin coat to increase whiteness. A thin gelatin layer of 0.05 to 0.4 $g/m^2$ may be provided on the surface of polyolefin-coated paper (on the image receiving layer side and/or the reverse side).

The thermal transfer image receiving material of the present invention may have an interlayer containing no water-soluble binder between the support and the image receiving layer.

The interlayer is a layer having any one or more of the functions of a cushioning layer, a porous layer and a dye diffusion-preventing layer depending on the materials which constitute the layer. The interlayer sometimes serves as an adhesive.

The dye diffusion-preventing layer plays a role in preventing the thermomobile dye from diffusing in the support. Water-soluble or organic solvent-soluble binders can be used as binders for the diffusion-preventing layer. Water-soluble binders are preferred. Examples of the water soluble binders include those already described for the image receiving layer, and gelatin is particularly preferred.

The porous layer is a layer which prevents heat applied during thermal transfer from diffusing from the image receiving layer into the support to utilize effectively the applied heat.

When the water-soluble polymers are used as the binders for the porous layer, the porous layer can be formed by (1) a method wherein porous fine particles are dispersed in a water-soluble polymer and the dispersion is coated and dried, (2) a method wherein a solution of a water-soluble polymer is mechanically stirred to form bubbles and the solution is coated and dried, (3) a method wherein a blowing agent is added to a solution of a water-soluble polymer and either expansion is conducted and then the solution is coated, or expansion is conducted during the course of coating and drying, or (4) a method wherein an organic solvent (preferably a solvent having a boiling point higher than that of water) is emulsified and dispersed in a solution of a water-soluble polymer, the dispersion is coated and dried, and microvoids are formed during the course of coating and drying.

When organic solvent-soluble binders are used as the binders for the porous layer, the porous layer can be formed by (1) a method wherein a solution of a synthetic resin emulsion such as a polyurethane emulsion or a synthetic rubber latex, such as a methyl methacrylate-butadiene rubber latex, is mechanically stirred to form bubbles and the solution is coated on the support and dried, (2) a method wherein a blowing agent is added to a solution of the synthetic resin emulsion or synthetic rubber latex and the resulting solution is coated on the support and dried, (3) a method wherein a blowing agent is added to a solution of a vinyl chloride plastisol, a synthetic resin such as polyurethane, or a synthetic rubber such as a styrene-butadiene synthetic rubber, and the mixture is coated on the support and expanded by heating, and (4) a method wherein a mixed solution consisting of a solution of a thermoplastic resin or synthetic rubber in an organic solvent and a non-solvent (including a non solvent mainly composed of water) which is less volatile than the organic solvent, has compatibility with the organic solvent and does not dissolve the thermoplastic resin or synthetic rubber, is coated on the support and dried to form a microporous layer.

The interlayer may be provided on both sides of the support when the image receiving layers are provided on both sides of the support. However, the interlayer may be provided only on one side thereof. The interlayer has a thickness of 0.5 to 50 μm, preferably 1 to 20 μm.

The image receiving layer, the cushioning layer, the porous layer, the diffusion-preventing layer, the adhesive layer, etc. of the thermal transfer image receiving material of the present invention may contain fine powders of silica, clay, talc, diatomaceous earth, calcium carbonate, calcium sulfate, barium sulfate, aluminum silicate, synthetic zeolite, zinc oxide, lithophone, titanium oxide and alumina.

The thermal transfer image receiving material may contain brightening agents. Examples of the brightening agents include compounds described in K. Veenkataraman, *The Chemistry of Synthetic Dyes*, Vol. 5, Chapter 8 and JP-A-61-143752. More specifically, examples of the brightening agents include stilbene compounds, coumarin compounds, biphenyl compounds, benzoxazolyl compounds, naphthalimide compounds, pyrazoline compounds, carbostyril compounds and 2,5-dibenzoxazolylthiophene compounds. The brightening agents may be used in combination with anti-fading agents.

The thermal transfer dye providing material is a material comprising a support having thereon a layer containing a thermomobile dye. Recording can be made by migrating the dye to the image receiving layer of the thermal transfer image receiving material in the form of a pattern corresponding to the heat pattern which has been applied.

Any of the conventional supports can be used as the supports for the thermal transfer dye providing materials. Examples of the supports include polyethylene terephthalate, polyamides, polycarbonates, glassine paper, condenser paper, cellulose esters, fluoropolymers, polyethers, polyacetals, polyolefins, polyimides, polyphenylene sulfide, polypropylene, polysulfone and cellophane.

The support of the thermal transfer dye providing material has generally a thickness of 2 to 30 μm and may optionally have an undercoat layer (subbing layer). If desired, a dye diffusion-preventing layer consisting of a hydrophilic polymer may be interposed between the support and the dye providing layer, whereby the transfer density can be further improved. The above-described water-soluble polymers can be used as hydrophilic polymers.

A slipping layer may be provided to prevent the thermal head from sticking to the dye providing material. The slipping layer comprises a lubricating substance with or without a polymer binder, such as a surfactant, a solid or liquid lubricant or a mixture thereof. The slipping layer has generally a thickness of 0.01 to 5 μm and preferably 0.1 to 1 μm.

If desired, two or more dye providing layers containing different dyes may be arranged on one thermal transfer dye providing material by choosing dyes so as to allow the desired hues to be transferred when printed. For example, when the printing of each color according to chrominance signals is repeatedly made to form an image as in a color photograph, it is desirable that the printed hue is in each of the cyan, magenta and yellow colors. In this case, three dye providing layers containing dyes giving such hues are arranged. If desired, a dye providing layer containing a dye giving a black hue may be provided in addition to the layers giving cyan, magenta and yellow colors. It is preferred that when these dye providing layers are formed, a mark for position detection is made simultaneously with the formation of any one of the dye providing layers, because extra inking or a printing stage is not required in addition to the formation of the dye providing layers.

The thermal transfer dye providing material using a thermomobile dye comprises basically a support having thereon a thermal transfer layer containing a binder and a dye which is made mobil or sublimes by heat. The thermal transfer dye providing material can be prepared in the following manner. A conventional dye which is made mobile or sublimes by heat and a binder resin are dissolved or dispersed in an appropriate solvent to prepare a coating solution. One side of the support for the conventional thermal transfer dye providing material is coated with the coating solution in such an amount as to give a dry film of about 0.2 to 5 μm, preferably 0.4 to 2 μm in thickness to form a thermal transfer layer.

Any of the dyes which are used for conventional thermal transfer dye providing materials can be used as dyes for use in the formation of the thermal transfer layers of the present invention. Dyes having a low molecular weight of about 150 to 800 are preferably used in the present invention. Dyes are chosen by taking transfer temperature, hue, light resistance and solubility or dispersibility in ink and binder resins into consideration.

Examples of the dyes include disperse dyes, basic dyes and oil-soluble dyes. More specifically, examples of preferred dyes include Sumikaron Yellow E4GL, Dianix Yellow H2G-FS, Miketon Polyesther Yellow 3GSL, Kayazet Yellow 937, Sumikaron Red EFBL, Dianix Red ACE, Miketon Polyester Red FB, Kayazet Red 126, Miketon Fast Brilliant Blue B and Kayazet Blue 136. Other conventional thermomobile dyes can also be used.

Any of the conventional binder resins can be used as binder resins used together with the dyes in the present invention. Generally, dyes are chosen from among those which have high resistance to heat and do not interfere with the migration of the dyes when heated. Examples of such binder resins include polyamide resins, polyester resins, epoxy resins, polyurethane resins, polyacrylic resins (e.g., polymethyl methacrylate, polyacrylamide, polystyrene-2-acrylonitrile), vinyl resins (e.g., polyvinyl pyrrolidone), polyvinyl chloride resins (e.g., vinyl chloridevinyl acetate copolymer), polycarbonate resins, polystyrene, polyphenylene oxide, cellulose resins (e.g., methyl cellulose, ethyl cellulose, carboxymethyl cellulose, cellulose acetate hydrogenphthalate, cellulose acetate, cellulose acetate propionate, cellulose acetate butyrate, cellulose triacetate), polyvinyl alcohol resins (e.g., polyvinyl alcohol, partially saponified polyvinyl alcohol such as polyvinyl butyral), petroleum resins, rosin derivatives, cumaroneindene resin, terpene resin and polyolefin resins (e.g., polyethylene, polypropylene).

The binder resins are used in an amount of preferably about 80 to 600 parts by weight per 100 parts by weight of the dye.

Any of the conventional ink solvents can be used as ink solvents for use in dissolving or dispersing the above-described dyes and binder resins.

Release agents may be incorporated in the layers of the dye providing material and/or the image receiving material to improve release properties between the thermal transfer dye providing material and the thermal transfer image receiving material. It is particularly preferred that the release agents are incorporated in the outermost layer where both materials are brought into contact with each other.

Conventional release agents can be used. Examples of the release agents include solid or waxy substances such as polyethylene wax and amide wax; surfactants such as phosphoric esters; oil such as paraffinic oil and silicone oil; and fine solid particles. Among them, silicone oil is particularly preferred.

Examples of a suitable silicone oil include unmodified silicone oil and modified silicone oil such as carboxy modified silicone oil, amino-modified silicone oil and epoxy-modified silicone oil. Specific examples of the modified silicone oil include those described in *Modified Silicone Oil* in Technical Data, pp. 6–18B, published by Shinetsu Silicone K.K.

The layers of the thermal transfer dye providing material and the thermal transfer image receiving material may be cured by using hardening agents.

Hardening agents described in JP A-61-199997 and JP-A-58-215398 can be used when organic solvent-soluble polymers are to be cured. For example, isocyanate hardening agents can be preferably used for polyester resins.

Hardening agents described in U.S. Pat. No. 4,678,739 (41st column), JP-A-59-116655, JP-A-62-245261 and JP-A-61-18942 can be used when water-soluble polymers are to be cured.

More specifically, examples of the hardening agents include aldehyde hardening agents (e.g., formaldehyde), aziridine hardening agents, epoxy hardening agents (e.g.,

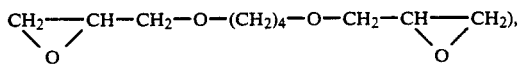

vinyl sulfone hardeninga gents (e.g., N,N'-ethylenebis(-vinylsulfonylacetamido)ethane), N-methylol hardening agents (e.g., dimethylolurea) and high-molecular weight hardening agents (e.g., compounds described in JP-A-62-234157).

The thermal transfer dye providing material and the thermal transfer image receiving material may contain anti-fading agents. Examples of the anti-fading agents include antioxidants, ultraviolet light absorbers and various metal complexes.

Examples of the antioxidants include chroman compounds, coumaran compounds, phenol compounds (e.g., hindered phenols), hydroquinone derivatives, hindered amine derivatives and spiro-indane compounds. Further, compounds described in JP-A-61-159644 can be effectively used.

Examples of the ultraviolet light absorbers include benztriazole compounds (e.g., those described in U.S. Pat. No. 3,533,794), 4-thiazolidone compounds (e.g., those described in U.S. Pat. No. 3,352,681), benzophenone compounds (e.g., those described in JP-A-56-2784) and compounds described in JP-A-54-48535, JP-A-62-136641 and JP-A-61-88256. Further, ultraviolet light absorbing polymers described in JP-A-62-260152 can be effectively used.

Examples of the metal complexes include compounds described in U.S. Pat. Nos. 4,241,155, 4,245,018 (3rd to 36th columns), 4,254,195 (3rd to 8th columns), JP-A-62-174741, JP-A-61-88256 (pages 27 to 29), Japanese Patent Application Nos. 62-234103 and 62-31096 (corresponding to JP-A-1075568 and JP-A-63-199248, respectively).

Examples of useful anti-fading agents are described in JP-A-62-215272 (pages 125 to 137).

The anti-facing agents may be previously incorporated in the image receiving material to prevent the dye transferred to the image receiving material from being faded. Alternatively, the anti-fading agents may be fed to the image receiving material from external sources. For example, the anti-fading agents may be transferred form the dye providing material to the iamge receiving material.

The above-described antioxidants, ultraviolet light absorbers and metal complexes may be used in combination.

The thermal transfer dye providing material and the thermal transfer image receiving material may contain matting agents. Examples of the matting agents include silicon dioxide, compounds such as polyolefins or polymethacrylates described in JP-A-61-88256 (page 29) and compounds such as benzoguanamine resin beads, polycarbonate resin beads and polystyrene resin beads described in Japanese Patent Application Nos. 62-110064 and 62-110065 (corresponding to JP-A-63-274944 and JP-A-63-274952, respectively).

The layers of the thermal transfer dye providing amterial and the thermal transfer image receiving material may contain various surfactants as a coating aid or for the purpose of improving release properties and slipperiness or imaprting antistatic properties.

Examples of the surfactants include nonionic surfactants, anionic surfactants, amphoteric surfactants and cationic surfactants. Specific examples of these surfactants are described in JP-A-62-173462 and JP-A-62-183457.

In the present invention, the thermal transfer dye providing material and the thermal transfer image receiving material are superimposed upon each other. Heat energy according to the information on the image is applied to the lmainate from either side, preferably from the back of the thermal transfer dye providing material, for example, by means of a heating device such as a thermal head to thereby transfer the dye in the dye providing material according to the intensity of heating energy to the thermal transfer image receiving material. In this way, a color image having excellent clarity and resolving gradation can be obtained.

Conventional heating means such as laser beam (e.g., semiconductor laser beam), infrared flash and a hot pen can be used in addition to the thermal head.

The combination of the thermal transfer dye providing material with the thermal transfer image receiving material according to the present invention can be used in the fields of printing by thermal printing type printers, facsimile, the preparation of the prints of images by magnetic recording systems, magneto-optical recording systems and optical recording systems and the preparation of prints from television and a CRT screen.

Thermal transfer recording systems are fully described in JP-A-60-34895.

The present invention is now illustrated in greater detail by reference to the following examples which, however, are not to be construed as limiting the invention in any way.

Unless otherwise indicated, all percents, ratios, parts, etc. are by weight.

EXAMPLE 1

Preparation of Thermal Transfer Dye Providing Material (A)

A polyester film (Rumilar, a product of Toray Industries, Inc.) of 4.5 μm in thickness, which had a heat-resisting slip layer consisting of a thermosetting acrylic resin on one side thereof, was used as a support. The other side of the support was coated with the following coating composition (A) for the formation of a thermal transfer dye providing layer by means of wire bar coating in such an amount as to give a dry film of 2 μm in thickness. A slipping layer comprising polyvinyl butyral (Butbar 76, a product of Monsanto) 0.45 g/m$^2$) and poly(vinyl stearate) (0.3 g/m$^2$) was formed on the back of the support by coating the back with a tetrahydrofuran solution, thus obtaining a thermal transfer dye providing material (A).

| Coating Composition (A) for the Formation of the Thermal Transfer Dye Providing Layer | |
|---|---|
| Disperse dye (2,3-diphenoxyanthraquinone) | 4 g |
| Polyvinyl butyral resin (Denka Butyral 5000-A, a product of Denki Kagaku) | 4 g |
| Methyl ethyl ketone | 40 ml |
| Toluene | 40 ml |
| Polyisocyanate (Takenate D110N, a product of Takeda Chemical Industries, Inc.) | 0.2 ml |
| Preparation of Dye Accepting Polymer Emulsion A | |
| Composition of Solution I | |
| Gelatin (10% aqueous solution) | 100 g |
| Sodium dodecylbenzenesulfonate (5% aqueous solution) | 50 ml |
| Water | 50 ml |
| Composition of Solution II | |
| Resin (1)* | 30 g |
| Toluene | 60 g |
| Methyl ethyl ketone | 60 g |
| Thermal solvent (1)* | 12 g |

Note:
Resin (1)*: Compounds used are given in Table 1 by parenthesized numbers which refer to the same parenthesized numbers described above for Compounds (1) to (37).
Thermal solvent (1)*: Diphenyl phthalate.

Solution II was prepared and then added to Solution I while stirring Solution I. The mixture was emulsified and dispersed in a homogenzier at 15,000 rpm for 9 minutes to prepare a dye accepting polymer emulsion A.

| Preparation of Dye Accepting Polymer Emulsion B | |
|---|---|
| Solution I | |
| Gelatin (10% aqueous solution) | 100 g |
| Sodium dodecylbenzenesulfonate (5% aqueous solution) | 50 ml |
| Water | 50 ml |
| Solution II | |
| Resin (2)* | 30 g |
| Toluene | 60 g |
| Methyl ethyl ketone | 60 g |
| Thermal solvent (1)* | 9 g |

Note:
Resin (2)*: Compounds used are given in Table 1 by patenthesized numbers which refer to the same parenthesized numbers described above for Compounds (1) to (37).

Solutions I and II were thoroughly dissolved. Solution II was then added to Solution I while stirring Solution I. The mixture was emulsified and dispersed in a homogenizer at 15,000 rpm for 9 minutes to prepare a dye accepting polymer emulsion B.

| Preparation of Coating Solution for Image Receiving Material | |
|---|---|
| First Layer: | |
| 10% aqueous solution of gelatin | 100 g |
| Water | 40 ml |
| Hardening agent (1)* (4% aqueous solution) | 60 ml |
| Second Layer: | |
| Dye accepting polymer emulsion A | 100 g |
| Water | 50 ml |
| Third Layer: Outermost Layer | |
| Dye accepting polymer emulsion B | 100 g |
| Water | 50 ml |

-continued

| Preparation of Coating Solution for Image Receiving Material | |
|---|---|
| Surfactant* (5% aqueous solution) | 6 ml |

Note:
Hardening agent (1)*: 1,2-bis(vinylsulfonylacetamido)-ethane
Note:

Surfactant*:

$$C_8F_{17}SO_2N(C_3H_7)-(CH_2CH_2O)_4-(CH_2)_4-SO_4Na$$

Preparation of Image Receiving Material

A support obtained by laminating both sides of paper having a basis weight of 180 g/m$^2$ with polyethylene containing titanium oxide dispersed therein, was coated with the above-described coating solutions of the first to third layers in such an amount as to give wet film thicknesses of 20, 60 and 15 ml/m$^2$, respectively. The coated support was dried to obtain each of the image receiving materials 101 to 107 given in Table 1.

The thus-obtained thermal transfer dye providing material and thermal transfer image receiving material were placed upon each other in such a manner that the dye providing layer and the image receiving layer were brought into contact with each other. Printing was carried out from the side of the support of the thermal transfer dye providing material by using a thermal head under such conditions that thermal head output was 0.25 W/dot, pulser width was 0.15 to 15 msec and dot density was 6 dots/mm. Magenta dye was imagewise transferred and fixed to the image receiving layer of the thermal transfer image receiving material.

The density of the dye transferred to the thermal transfer image receiving material was measured by using X-rite. 310RT (manufactured by X-rite Co.). Maximum density (Dmax) is shown in Table 1.

The printed thermal transfer image receiving material and an unprinted (fresh) thermal transfer image receiving material were placed on each other in such a manner that both image receiving layer-coated surfaces are brought into contact with each other. A load of 20 g per cm$^2$ was applied thereto. The materials were stored in a constant temperature bath at 60° C. for 24 hours under the load, and were then peeled off from each other. The evaluation of the high and low degrees of the density of the dye re-transferred from the printed image receiving material to the unprinted image receiving material was made in 4 grades of A (little re-transferred) to D (greatly re-transferred). The results are shown in Table 1 under the column entitled "Color Migration by Contact".

TABLE 1

| Image Receiving Material | Resin (1)* of Second Layer (Tg) | Resin (2)* of Third Layer (Outermost Layer) (Tg) | | Color Migration by Contact | G Density (Dmax) |
|---|---|---|---|---|---|
| 101 (Comparison) | (22) (7° C.) | (22) | (7° C.) | D | 1.72 |
| 102 (Comparison) | (28) (67° C.) | (22) | (7° C.) | D | 1.69 |
| 103 (Invention) | (22) (7° C.) | (10)/(22) = 93/7 weight ratio | (26° C.) calc | B | 1.73 |
| 104 (Invention) | (28) (67° C.) | (10)/(22) = 93/7 weight ratio | (26° C.) calc | B | 1.68 |
| 105 (Invention) | (22) (7° C.) | (28) | (67° C.) | A | 1.68 |
| 106 (Invention) | (18) (47° C.) | (28) | (67° C.) | A | 1.67 |
| 107 (Invention) | (28) (68° C.) | (18) | (47° C.) | A-B | 1.68 |

The following matters will be understood from Table 1.

(1) When dye accepting polymer or the dye accepting polymer blend each having a Tg of not lower than 20° C. is incorporated in the outermost layer according to the present invention, the property with regard to the problem of color migration by contact can be greatly improved with causing almost no lowering in density. Particularly, the image receiving materials 105 and 106 containing the dye accepting polymer having a Tg of 67° C. in the outermost layer thereof are remarkably improved.

(2) When the dye accepting polymer or the dye accepting polymer blend contained in the outermost layer has a Tg of not lower than 20° C. (particularly not lower than 40° C., more particularly not lower than 55° C.), the property with regard to color migration by contact is scarcely deteriorated, even though a dye accepting polymer having a Tg of not higher than 20° C. is incorporated in a layer nearer to the support.

EXAMPLE 2

Thermal transfer image receiving materials 201 to 210 were prepared in the same way as in the preparation of the thermal transfer image receiving material of Example 1 except that the resins (1)* and (2)* given in Table 2 were used, 3 g of epoxy-modified silicone oil (KF-100T, a product of Shinetsu Silicone K.K.) was added to Solution II in the preparation of the dye accepting polymer emulsion B, and 6 g of a dispersion (solid content: 20%) of fluorine compound fine particles (Rublon L-2, a product of Daikin Kogyo Co., Ltd.) was added to the coating solution for the third layer (outermost layer) in the preparation of the coating solution for the image receiving material.

The evaluation of these image receiving materials was made in the same way as in Example 1.

The results are shown in Table 2.

TABLE 2

| Image Receiving Material | Resin (1)* of Second Layer (Tg) | Resin (2)* of Third Layer (Outermost Layer) (Tg) | | Color Migration by Contact | G Density (Dmax) |
|---|---|---|---|---|---|
| 201 | (27)/(22) = 75/25 (21.5° C.) | (26) | (4° C.) | D | 1.93 |

TABLE 2-continued

| Image Receiving Material | Resin (1)* of Second Layer (Tg) | Resin (2)* of Third Layer (Outermost Layer) (Tg) | | Color Migration by Contact | G Density (Dmax) |
|---|---|---|---|---|---|
| (Comparison) 202 | (ratio by weight) (27)/(22) = 75/25 (21.5° C.) | (24) | (7° C.) | D | 1.92 |
| (Comparison) 203 | (ratio by weight) (27)/(22) = 75/25 (21.5° C.) | (19) | (15° C.) | D | 1.95 |
| (Comparison) 204 | (ratio by weight) (27)/(22) = 75/25 (21.5° C.) | (20) | (26° C.) | B | 1.90 |
| (Invention) 205 | (ratio by weight) (27)/(22) = 75/25 (21.5° C.) | (16) | (47° C.) | B–A | 1.86 |
| (Invention) 206 | (ratio by weight) (27)/(22) = 75/25 (21.5° C.) | (15) | (77° C.) | A | 1.89 |
| (Invention) 207 | (ratio by weight) (27)/(22) = 75/25 (21.5° C.) | (27) | (70° C.) | A | 1.99 |
| (Invention) 208 | (ratio by weight) (27)/(22) = 75/25 (21.5° C.) | (29) | (65° C.) | A | 1.83 |
| (Invention) 209 | (ratio by weight) (27)/(22) = 75/25 (21.5° C.) | (32) | (60° C.) | A | 1.88 |
| (Invention) 210 | (ratio by weight) (27)/(22) = 75/25 (21.5° C.) | (27)/(22) = 75/25 (21.5° C.) (ratio by weight) | | B | 1.98 |

It can be understood from the results of Table 2 that the thermal transfer image receiving materials containing the dye accepting polymers or the dye accepting polymer blend each having a Tg of not lower than 20° C. dispersed in gelatin contained in the outermost layer thereof according to the present invention, hardly caused a lowering in transfer density and hardly caused color migration by contact.

According to the present invention, thermal transfer image receiving materials can be obtained which have excellent suitability for production, a high pitcure quality and improved image storage stability.and scarcely cause problems with regard to the fading of the transferred image with the passage of time, the re-transfer of dye to other materials (color migration by contact) after transfer and the heat fusion thereof to the dye providing materials.

Further, a higher transfer density can be obtained when a dye accepting polymer or a dye accepting polymer blend as the dye accepting substance to be dispersed in the water-soluble binder is incorporated in a layer nearer to the support, wherein the dye accepting polymer or the dye accepting polymer blend each has a glass transition point lower than that of the dye accepting polymer or the dye accepting polymer blend to be contained in the outermost layer.

While the invention has been described in detail and with reference to specific embodiments thereof, it will be apparent to one skilled in the art that various changes and modifications can be made therein without departing from the spirit and scope thereof.

What is claimed is:

1. A thermal transfer image receiving material comprising a support having thereon at least one image receiving layer which accepts a dye to form an image, said dye migrating from a thermal transfer dye providing material when heated, wherein said at least one image receiving layer comprises gelatin containing a dye accepting substance dispersed therein, and at least the outermost layer of the image receiving side-constituting layers of the image receiving material contains at least a dye accepting polymer or a dye accepting polymer blend, each having a glass transition point (Tg) of not lower than 20° C., as a dye accepting substance which is dispersed in gelatin in at least said outermost layer.

2. The thermal transfer image receiving material of claim 1, wherein said material comprises a support having thereon at least two image receiving layers which accept a dye to form an image, such that at least an outermost image receiving layer and an image receiving layer nearest to the support are present, wherein high-boiling organic solvents are present at least in the image receiving layer nearest to the support.

3. The thermal transfer image receiving material of claim 1, wherein said material comprises a support having theroen at least two image receiving layers which accept a dye to form an image, such that at least an outermost image receiving layer and an image receiving layer nearest to the support are present, wherein solvents which are compatible with the dye, which are solid at room temperature but are molten when heated by a thermal head, and which are not decomposed by heat from the thermal head are present at least in the image receiving layer nearest to the support.

4. The thermal transfer image receiving material of claim 1, wherein fluroine compounds are contained in the outermost layer.

5. The thermal transfer image receiving material of claim 1, wherein release agents are contained in the outermost layer.

6. The thermal transfer image receiving material of claim 1, wherein the water-soluble binder is a water-soluble polymer having a group capable of being cross-linked in the presence of hardening agents, with the hardening agents being contained in the thermal transfer image receiving material.

* * * * *